US006659594B2

(12) United States Patent
Mizutani

(10) Patent No.: US 6,659,594 B2
(45) Date of Patent: Dec. 9, 2003

(54) INKJET RECORDING HEAD AND INKJET RECORDING APPARATUS

(75) Inventor: Michinari Mizutani, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/164,399

(22) Filed: Jun. 10, 2002

(65) Prior Publication Data

US 2002/0154183 A1 Oct. 24, 2002

Related U.S. Application Data

(62) Division of application No. 09/824,656, filed on Apr. 4, 2001, now Pat. No. 6,428,144.

(30) Foreign Application Priority Data

Apr. 4, 2000 (JP) ..... 2000-102107

(51) Int. Cl.[7] ..... B41J 2/05
(52) U.S. Cl. ..... 347/57; 347/65
(58) Field of Search ..... 347/47, 56, 57, 347/58, 65

(56) References Cited

U.S. PATENT DOCUMENTS 4,794,411 A * 12/1988 Taub et al. ..... 347/47
4,967,208 A * 10/1990 Childers ..... 347/56
5,818,478 A * 10/1998 Gibson ..... 347/45
5,874,974 A * 2/1999 Courian et al. ..... 347/65

* cited by examiner

*Primary Examiner*—Stephen D. Meier
*Assistant Examiner*—Michael S Brooke
(74) *Attorney, Agent, or Firm*—Fitzpatrick, Cella, Harper & Scinto

(57) ABSTRACT

In an inkjet recording head having a plurality of ink ejecting ports and a plurality of energy generating elements respectively positioned in confrontation with the ink ejecting ports for generating energy utilized to eject ink from the ink ejecting ports, the plurality of ink ejecting ports and the plurality of energy generating elements being divided into a plurality of blocks, and the ejecting ports and the energy generating elements being timeshapred driven in a sequence of the blocks in a common driving period, the plurality of energy generating elements are disposed in an approximate sraight line, and the respective ink ejecting ports are off-set with respect to the energy generating elements in a projecting relationship in correspondence to the sequence of the timeshapred drive. With this construction, the inkjet recording head can maximize a refill cycle while keeping the linearity of an image even if timeshared drive is executed, whereby the throughput of a printer using the inkjet recording head can be improved.

7 Claims, 12 Drawing Sheets

FIG. 4

⊙ INK DROPLET OF SEGMENT 0

⊙ INK DROPLET OF SEGMENT 2

⊙ INK DROPLET OF SEGMENT 4

⊙ INK DROPLET OF SEGMENT 6

⊙ INK DROPLET OF SEGMENT 8

⊙ INK DROPLET OF SEGMENT 10

⊙ INK DROPLET OF SEGMENT 12

⊙ INK DROPLET OF SEGMENT 14

⊙ INK DROPLET OF SEGMENT 16

⊙ INK DROPLET OF SEGMENT 18

⊙ INK DROPLET OF SEGMENT 20

⊙ INK DROPLET OF SEGMENT 22

⊙ INK DROPLET OF SEGMENT 24

⊙ INK DROPLET OF SEGMENT 26

⊙ INK DROPLET OF SEGMENT 28

⊙ INK DROPLET OF SEGMENT 30

→ PRINT DIRECTION

INKJET RECORDING HEAD AND INKJET RECORDING APPARATUS

CROSS REFERENCE TO RELATED APPLICATION

This application is a division of application Ser. No. 09/824,656, now U.S. Pat. No. 6,428,144, filed Apr. 4, 2001.

BACKGROUND OF THE INVENTION

1. Field of the Invention

The present invention relates to an inkjet recording head and an inkjet recording apparatus for recording data on a material to be recorded by ejecting ink as liquid droplets. The present invention is applicable to apparatuses such as copy machines, facsimiles having a communication system, word processors having a print unit, and the like, and further to industrial recording apparatuses which are in complex combination with various processing apparatuses, in addition to ordinary printers.

In the specification, a term "print" (sometimes, also referred to as "recording") not only means a case in which meaningful information of characters, graphics, and the like is formed but also widely means a case in which images, shapes, patterns, and the like are formed on a print medium or the print medium is processed so as to show them thereon regardless of that they are meaningful or meaningless and that they are made obvious so as to be visually recognized by a person or not. The term "print medium" used here not only means paper used in an ordinary printer but also widely means ink recipients such as cloth, plastic, film, metal sheet, glass, ceramics, wood, leather, and the like. Further, the term "ink" (sometimes, also referred to as "liquid") must be widely interpreted similarly to the definition of the term "print" and means a liquid which can form images, shapes, patterns, and the like by being applied onto a print medium or a liquid used to process a print medium or ink (for example, to solidify color agents in ink or to make the color agents insoluble).

2. Description of the Related Art

Recently, the performance of inkjet printers has been remarkably improved. Inkjet printers of late have realized a print speed as high as that of laser beam printers. Further, it is more and more required to increase a print speed of color images as a processing speed of personal computers is increased and the Internet becomes widespread.

A bubble jet recording system as one of inkjet recording systems is arranged such that ink is abruptly heated and vaporized by a heating element and the ink is ejected as liquid droplets from ejection ports (orifices) making use of the pressure of generated bubbles. Bubbles generated in a bubble jet recording head finally disappear because they are cooled by the ink in the vicinity of them and the vapor of the ink in the bubbles is condensed and returned to a liquid. The ink consumed by being ejected is refilled from an ink supply port through an ink supply path. Further, there is also available a recording system for abruptly heating and vaporizing ink by a heating element and ejecting generated bubbles by communicating them to the outside air.

A bubble jet recording heads according to a background art will be described. FIG. 6 is a schematic view showing a structure nozzles (ink flow paths to ejecting ports) of a first example of the bubble jet recording head according to the background art, and FIG. 7 is an enlarged schematic view showing traces of ink droplets recorded by the structure off the nozzles of the first example.

When an inkjet head as shown in FIG. 6 in which ink ejecting ports 3 and heaters (not shown), which are disposed inwardly of the ejecting port 3, are disposed in a single row, respectively, no difference is caused in the refill of ink because the ink flow paths 6 in respective segments have the same length. However, when timeshared drive is executed, positions at which ink droplets arrive are off-set in correspondence a sequence of drive, by which a problem is arisen in the formation of an image. FIG. 7 shows a case in which linear image data is printed using even segments, wherein a straight line is printed as zigzag lines spaced apart from each other by a maximum of 42.3 $\mu$m.

Whereas, when the timeshared drive is not executed, a problem is arisen in that a value of a current which instantly flows to heaters and electrodes increases and a voltage is dropped, and thus a print fades when an image of high duty is printed.

Another background art of a bubble jet recording head will be described. FIG. 8 is a schematic view showing a nozzle structure as a second example of the bubble jet recording head according to the background art.

In FIG. 8, the nozzles have a density is 600 dpi. A heating element (not shown) and an ink ejecting port 3 are disposed in a nozzle at positions which are different on a segment 0 side (even segments) and on a segment 2 side (odd segments). That is, the ink flow paths 6 on the even number segment side are made longer in a sequence of the segment numbers 2, 4, 6, 8, and 0, whereas the ink flow paths 6 on the odd number segment side are made shorter in a sequence of the segment numbers 3, 5, 7, 9, and 1, whereby the above problem of the first example is solved. In FIG. 8, an ink supply path 1 is disposed vertically at a center, and ink is supplied to the respective nozzles from a segment 0 to a segment 255 through the ink flow paths 6 having a different length.

Since a lot of nozzles, that is, 256 nozzles are provided, a value of a current which flows instantly is suppressed by executing a timeshared drive as described below. In the even segments, the eight nozzles of the segments 0, 32, 64, 96, 128, . . . , 224 are arranged as a first block, and the eight nozzles of the segments 10, 42, 74, . . . , 234 are arranged as a second block. Whereas, in the odd segments, the eight nozzles of the segments 17, 49, 81, 113, . . . , 241 are arranged as a first block, and the eight nozzles of the segments 27, 59, 91, . . . , 251 are arranged as a second block. In this construction, respective eight nozzles of the odd and even side segments are arranged as one block unit, and the odd side segments and the even side segments are divided into 16 blocks, respectively. Since the arrangements of a third block to a sixteenth block are similar to those described later, the description of them is omitted here.

When the image data of the segments 0 to 31 shown in FIG. 8 is turned ON and flows, drive pulses are applied to the heating elements of the segments 0 to 31 in a sequence of the block numbers 1 to 16. At that time, the drive pulses are applied to the respective blocks at intervals of 5.9 $\mu$s and drive every 16 nozzles on one side. In the even segments, a segment having a larger distance (hereinafter, referred to as C–H distance) between an heating element and an ink supply port (a position 5 branched from an ink supply path) is driven earlier. Whereas, in the odd segments, a segment having a shorter C–H distance is driven earlier.

When the drive pulses are applied to the heating elements, ink droplets are ejected from ejecting ports. While consumed ink is refilled from the ink supply ports through the ink supply path 1, a time at which the ink is refilled to a segment having a longer C–H distance is delayed as compared with a time at which it is refilled to a segment having a shorter C–H distance by the difference of the distance thereof. Thus, a problem is arisen in that the throughput of a printer cannot be increased because a response cycle must be set in accordance with a long C–H distance to obtain good print quality.

In contrast, while a fixed C–H distance can be set to all the nozzles when the ink supply ports are disposed zigzag, a problem is arisen in this case in that a refill time is delayed because the width of the supply ports of the portions thereof disposed zigzag is narrowed.

SUMMARY OF THE INVENTION

Accordingly, it is an object of the present invention to provide an inkjet recording head and an inkjet recording apparatus capable of maximizing a refill cycle while keeping the linearity of an image even if timeshared drive is executed and capable of improving the throughput of a printer.

Another object of the present invention is to provide an inkjet recording head and an inkjet recording apparatus for ejecting ink droplets in an off-set state without changing a length of ink flow paths to keep the linearity of an image.

A still another object of the present invention is to provide an inkjet recording head having a plurality of ink ejecting ports and a plurality of energy generating elements respectively positioned in confrontation with the ink ejecting ports for generating energy utilized to eject ink from the ink ejecting ports, the plurality of ink ejecting ports and the plurality of energy generating elements being divided into a plurality of blocks, and the ejecting ports and the energy generating elements being timeshared driven in a sequence of the blocks in a common driving period, wherein the plurality of energy generating elements are disposed in an approximate straight line, and the respective ink ejecting ports are off-set with respect to the energy generating elements in a projecting relationship in correspondence to the sequence of the timeshared drive and to provide an inkjet recording apparatus having the inkjet recording head.

A further object of the present invention is to provide an inkjet recording head having a plurality of ink ejecting ports and a plurality of energy generating elements respectively positioned in confrontation with the ink ejecting ports for generating energy utilized to eject ink from the ink ejecting ports, the plurality of ink ejecting ports and the plurality of energy generating elements being divided into a plurality of blocks, and the ejecting ports and the energy generating elements being timeshared driven in a sequence of the blocks in a common driving period, wherein the plurality of ink ejecting ports are disposed in an approximate straight line, and the respective energy generating elements are off-set with respect to the ink ejecting ports in a projecting relationship in correspondence to the sequence of the timeshared drive and to provide an inkjet recording apparatus having the inkjet recording head.

According to the present invention, since any ones of the energy generating elements and the ink ejecting ports are disposed in the approximate straight line and the positions of the energy generating elements are relatively off-set with respect to the positions of the ink ejecting ports, the linearity of an image can be maintained even if the timeshared drive is executed. Further, when the intervals between the energy generating elements and the positions where ink flow paths are branched from ink supply ports is made as short as possible within a range of allowance required in manufacture as to all the nozzles, a refill cycle can be maximized, whereby a throughput of a printer can be improved.

Further objects, features and advantages of the present invention will become apparent from the following description of the preferred embodiments with reference to the attached drawings.

BRIEF DESCRIPTION OF THE DRAWINGS

FIG. 4 is an enlarged schematic view showing traces of ink droplets recorded by the structure of the nozzles of the first embodiment;

DESCRIPTION OF THE PREFERRED EMBODIMENTS

Embodiments of the present invention will be described with reference to the drawings. In the present invention, an expression that "A is off-set with respect to B in a projecting relationship" means that "a center line of A is off-set with respect to a center line of B". Further, when a term "approximate" is used in the present invention, while a term modified by the term "approximate" is outside of the range of the term itself, the difference of the modified term is very small or the modified term is within a range of error.

First Embodiment

A first embodiment shows a case in which ejecting ports are off-set with respect to heaters disposed in a straight line.

Figure 1:
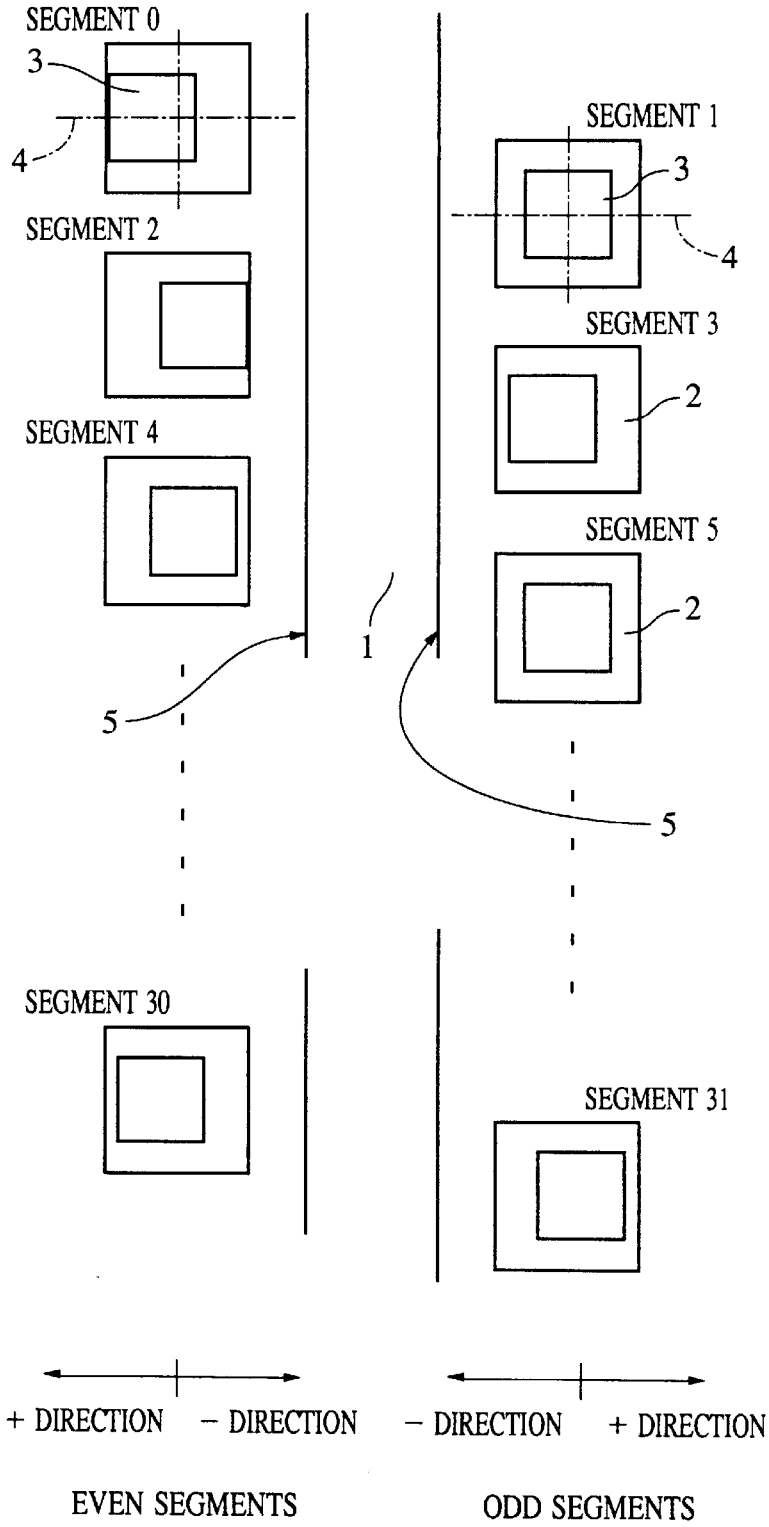
FIG. 1 is a schematic view showing a nozzle structure of an inkjet recording head as a first embodiment of the present invention.

FIG. 1 is a schematic view showing a nozzle structure of an inkjet recording head as the first embodiment of the present invention. The inkjet recording head of the embodiment is of a so-called side shooter type (refer to FIG. 2).

Note that FIG. 1 shows only 32 nozzles for the convenience of description as apparent from the following description. Further, both ejecting ports 3 and hearers 2 are shown by solid lines in order to indicate a positional relationship therebetween.

As shown in FIG. 1, the hearers 2 are disposed in a straight line. The reference number 4 is a dot-dash-line showing a center of the heater 2. The heaters are disposed in two rows (even and odd rows) while keeping the same distances from the ends of ink flow paths (not shown) branched from an ink supply path 1 to respective nozzles (positions 5 branched from the ink supply path 1) to the hearers 2. Each heater is formed in a square shape having the same size of 36 μm, and each ejecting port is formed in a square shape of 26 μm. A nozzle density is set to 600 dpi, and an interval between segments 0 and 1 is set to 42.3 μm.

Incidentally, as a result of a diligent study, the inventors have found that when an ejecting port 3, which is in confrontation with a thermal energy generator (heater) 2 disposed in an ink flow path 6, is located at a position slightly off-set in a direction where the ejecting port 3 is near to or far from the ink supply path 1 (or the branch position 5), there is a tendency that a position at which an ink droplet arrives is off-set in a direction where the ejecting port 3 is off-set (refer to FIG. 2).

Figure 2A:
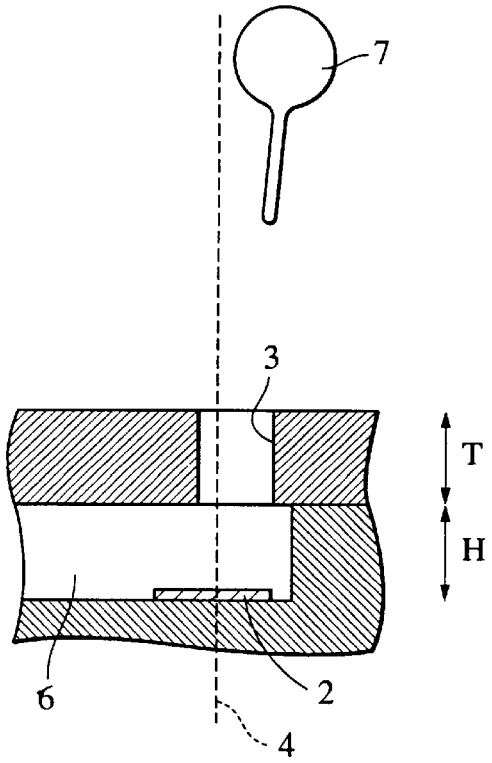
FIG. 2A is a sectional view of a nozzle the center of an ejecting port of which is off-set near to a branch position side with respect to a heater.
Figure 2B:
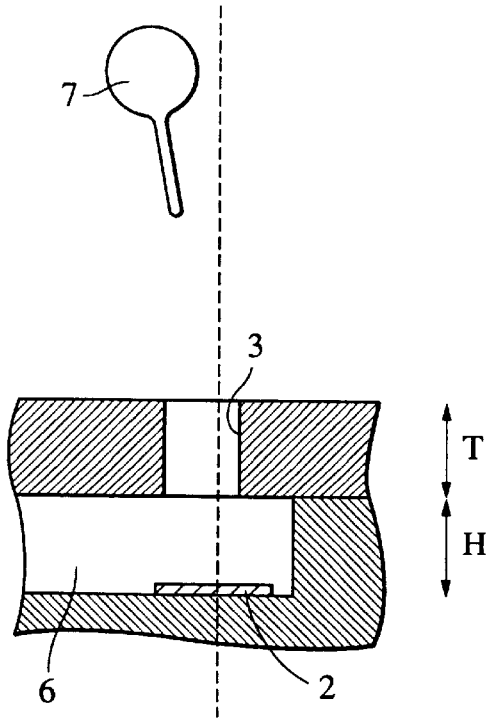
FIG. 2B is a sectional view of a nozzle the center of an ejecting port of which is off-set far from a branch position side with respect to a heater.

FIG. 2A is a sectional view of a nozzle the center of an ejecting port of which is off-set near to a branch position side with respect to a heater, and FIG. 2B is a sectional view of a nozzle the center of an ejecting port of which is off-set far from a branch position side with respect to a heater.

It should be noted that while FIG. 2 shows an odd nozzle, it is a matter of course that an even nozzle also tends to eject an ink droplet in an off-set state as shown in FIG. 2 without the need of illustrating it. Further, in FIG. 2, a flow path has a height H set to 17 μm, and an orifice plate has a thickness T set to 9 μm. While the ejecting port is formed in a squire shape in FIG. 2 for the sake of convenience, a similar effect can be obtained even if it is formed in, for example, a rectangular, circular, or star shape.

Figure 3:
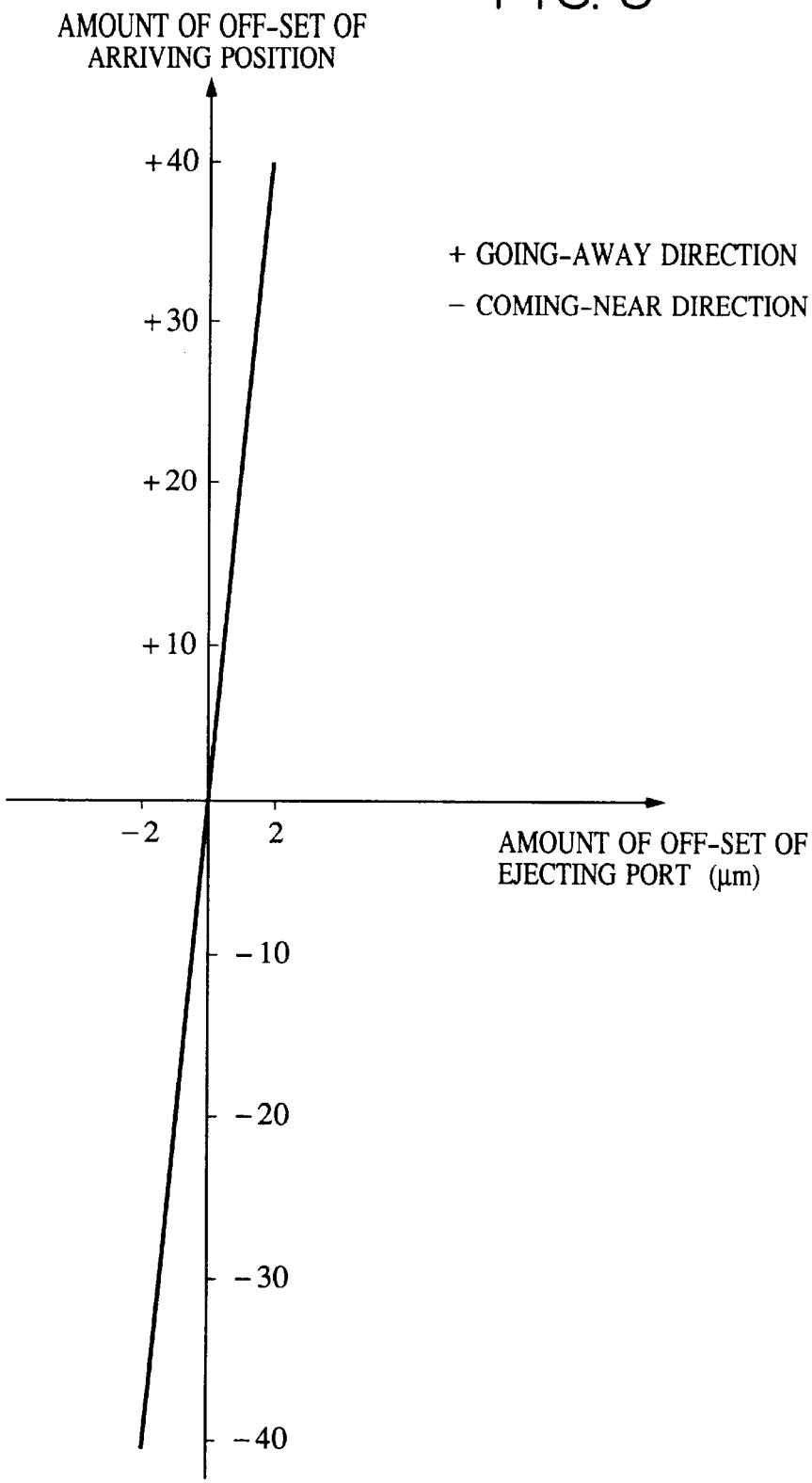
FIG. 3 is a graph showing a relationship between an amount of off-set of an ejecting port and an off-set amount of an ink droplet arriving position.

FIG. 3 is a graph showing a relationship between an amount of off-set of an ejecting port and an amount of off-set of arriving position of an ink droplet.

As shown in FIGS. 2 and 3, when an amount of off-set of the ejecting port 3 with respect to the hearer 2 has a positive value, the ejecting port 3 is off-set in a direction where it is far from the ink supply path 1, whereas when it has a negative value, the ejecting port 3 is off-set in a direction where it is near to the ink supply path 1. In the present invention, an ejecting direction of an ink droplet can be controlled by adjusting an amount of off-set of each ejecting port in accordance with a driving sequence thereof in timeshared drive, making use of the above phenomenon.

Thus, the distances between the centers of the respective hearers 2 of the segments 0, 2, 4, . . . , 30 of an even heater group on a left side shown in FIG. 1 and the centers of the ejecting ports 3 of the respective segments are set as follows.

That is, the segment 0 is off-set +2.0 μm, the segment 2 is off-set −1.5 μm, the segment 4 is off-set −0.5 μm, the segment 6 is off-set 0 μm, the segment 8 is off-set +1.0 μm, the segment 10 is off-set +2.0 μm, the segment 12 is off-set −2.0 μm, the segment 14 is off-set −1.0 μm, the segment 16 is off-set 0 μm, the segment 18 is off-set +0.5 μm, the segment 20 is off-set +1.5 μm, the segment 22 is off-set −2.0 μm, the segment 24 is off-set −1.0 μm, the segment 26 is off-set −0.5 μm, the segment 28 is off-set +0.5 μm, and the segment 30 is off-set +1.0 μm, in correspondence to the sequence of the timeshared drive.

In contrast, the distances between the centers of the respective hearers of the segments 1, 3, 5, . . . , 31 of an odd heater group on a right side shown in FIG. 1 and the centers of the ejecting ports of the respective segments are set as follows. That is, the segment 1 is off-set 0 μm, the segment 3 is off-set −0.5 μm, the segment 5 is off-set −1.5 μm, the segment 7 is off-set +2.0 μm, the segment 9 is off-set +1.0 μm, the segment 11 is off-set +0.5 μm, the segment 13 is off-set −0.5 μm, the segment 15 is off-set −1.0 μm, the segment 17 is off-set −0.2 μm, the segment 19 is off-set +1.5 μm, the segment 21 is off-set +0.5 μm, the segment 23 is off-set 0 μm, the segment 25 is off-set −1.0 μm, the segment 27 is off-set −2.0 μm, the segment 29 is off-set +2.0 μm, and the segment 31 is off-set +1.0 μm.

Operation of the inkjet recording head of the first embodiment will be explained with reference to the drawings.

First, when pulses are applied to the heaters, ink is supplied from the ink supply path 1 at the center to the nozzles of the segments 0 to 255 through the ink flow paths, and ink droplets are ejected from the ejecting ports 3. Since a lot of the nozzles, that is, the 256 nozzles are provided, a value of a current that flows instantly is suppressed by executing the timeshared drive as described below.

In the even segments, the eight nozzles of the segments 0, 32, 64, 96, 128, . . . , 224 are arranged as a first block, whereas, in the odd segments, the eight nozzles of the segments 17, 49, 81, 113, . . . , 241 are arranged as a first block.

In the even segments, a second block is composed of the segments 10, 42, 74, . . . , 234, whereas, in the odd segments, a second block is composed of the segments 27, 59, 91, . . . , 251. Then, every eight nozzles are driven on one side. In the same way, third blocks are composed of the even segments 20, 52, . . . , 244 and the odd segments 5, 37, 69, . . . , 229; fourth blocks are composed of the even segments 30, 62, . . . , 254 and the odd segments 15, 47, 79 . . . , 239; fifth blocks are composed of the even segments 8, 40, . . . , 232 and the odd segments 25, 57, 89, . . . , 249; sixth blocks are composed of the even segments 18, 50, . . . , 242 and the odd segments 3, 35, . . . , 227; seventh blocks are composed of the even segments 28, 60, . . . , 252 and the odd segments 13, 45 . . . , 237; eighth blocks are composed of the even segments 6, 38, . . . , 230 and the odd segments 23, 55, . . . , 247; ninth blocks are composed of the even segments 16, 48, . . . , 240 and the odd segments 1, 33, . . . , 225; tenth blocks are composed of the even segments 26, 58, . . . , 250 and the odd segments 11, 43, . . . , 235; eleventh blocks are composed of the even segments 4, 36, . . . , 228 and the odd segments 21, 53, . . . , 245; twelfth blocks are composed of the even segments 14, 46, . . . , 238 and the odd segments 31, 63, . . . , 255; thirteenth blocks are composed of the even segments 24, 56, . . . , 248 and the odd segments 9, 41, . . . , 233; fourteenth blocks are composed of the even segments 2, 36, . . . , 226 and the odd segments 19, 51, . . . , 243; fifteenth blocks are composed of the even segments 12, 46, . . . , 236 and the odd segments 29, 61, . . . , 253; and sixteenth blocks are composed of the even segments 22, 56, . . . , 246 and the odd segments 7, 39, . . . , 247.

When the image data of the segments 0 to 31 shown in FIG. 1 is turned ON and flows, drive pulses are applied to the heating elements of the segments 0 to 31 in a sequence of the block numbers 1 to 16. At that time, the drive pulses are applied to the respective blocks at intervals of 5.9 μs.

The ejecting ports of the segments in the blocks which are timeshared driven first, second, and third to seventhly, for example, the ejecting ports of the above-mentioned even segments 0, 10, 20, 30, 8, 18, and 28 are off-set in the (+) direction where the ejecting ports are apart from the ink supply path 1. Accordingly, the ejecting ports eject ink droplets 7 in a direction similar to that shown in FIG. 2A. Likewise, the ejecting ports of the odd segments 17, 27, 5, 15, 25, 3, and 13 are off-set in the (−) direction where they are near to the ink supply path 1. Thus, the ejecting ports eject ink droplets 7 in a direction similar to that shown in FIG. 2B. In this case, it can be said that the first to seventh even segments execute "going-away" ejection, and the first to seventh odd segments execute "coming-near" ejection.

Here, an ejection mode in which the ejecting ports of the even segments or the odd segments eject ink dropletso that the ink droplets go away from the ink supply path 1 is defined as the "going way" ejection, whereas an ejection mode in which they eject ink dropletso that the ink droplets come near to the ink supply path 1 is defined as the "coming-near" ejection. According to this definition, FIG. 2A shows the "going-away" ejection, and FIG. 2B shows the "coming-near" ejection. As to a relationship between an amount of off-set of ejecting port and an amount of off-set of arriving position, a larger amount of off-set of ejecting port causes an ejecting direction to be off-set in a larger amount.

The ejecting directions of the segments which are timeshared driven eighthly and ninthly (for example, the even segments 6 and 16 and the odd segments 23 and 1 which were described above) are not changed because these segments are not off-set.

As to the segments in the blocks which are timeshared driven tenthly to sixteenthly (for example, the even segments 26, 4, 14, 24, 2, 12, and 22 and the odd segments 11, 21, 31, 9, 13, 29, and 7 which were described above), the even segments execute the "coming-near" ejection similarly to that shown in FIG. 2B, whereas the odd segments execute the "going-away" ejection similarly to that shown in FIG. 2A, inversely.

Figure 7:
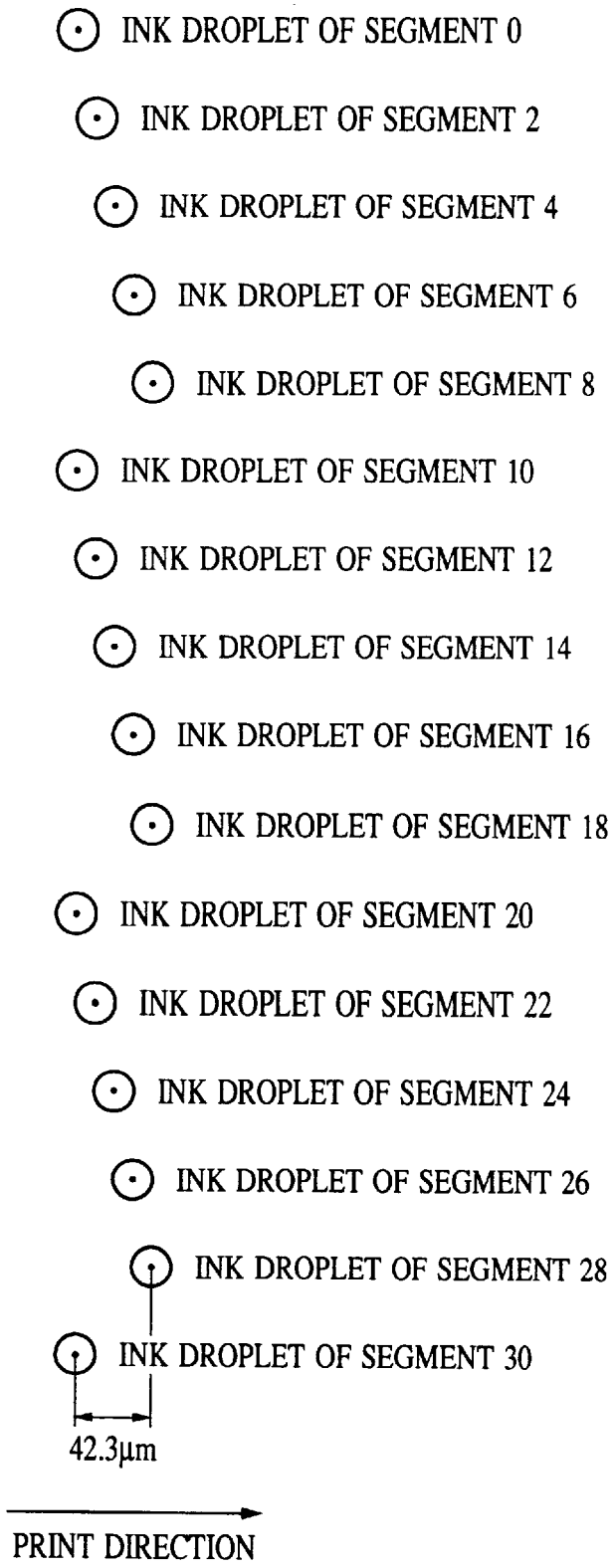
FIG. 7 is an enlarged schematic view showing traces of ink droplets recorded by the structure of the nozzles of the first example according to the background art.
Figure 8:
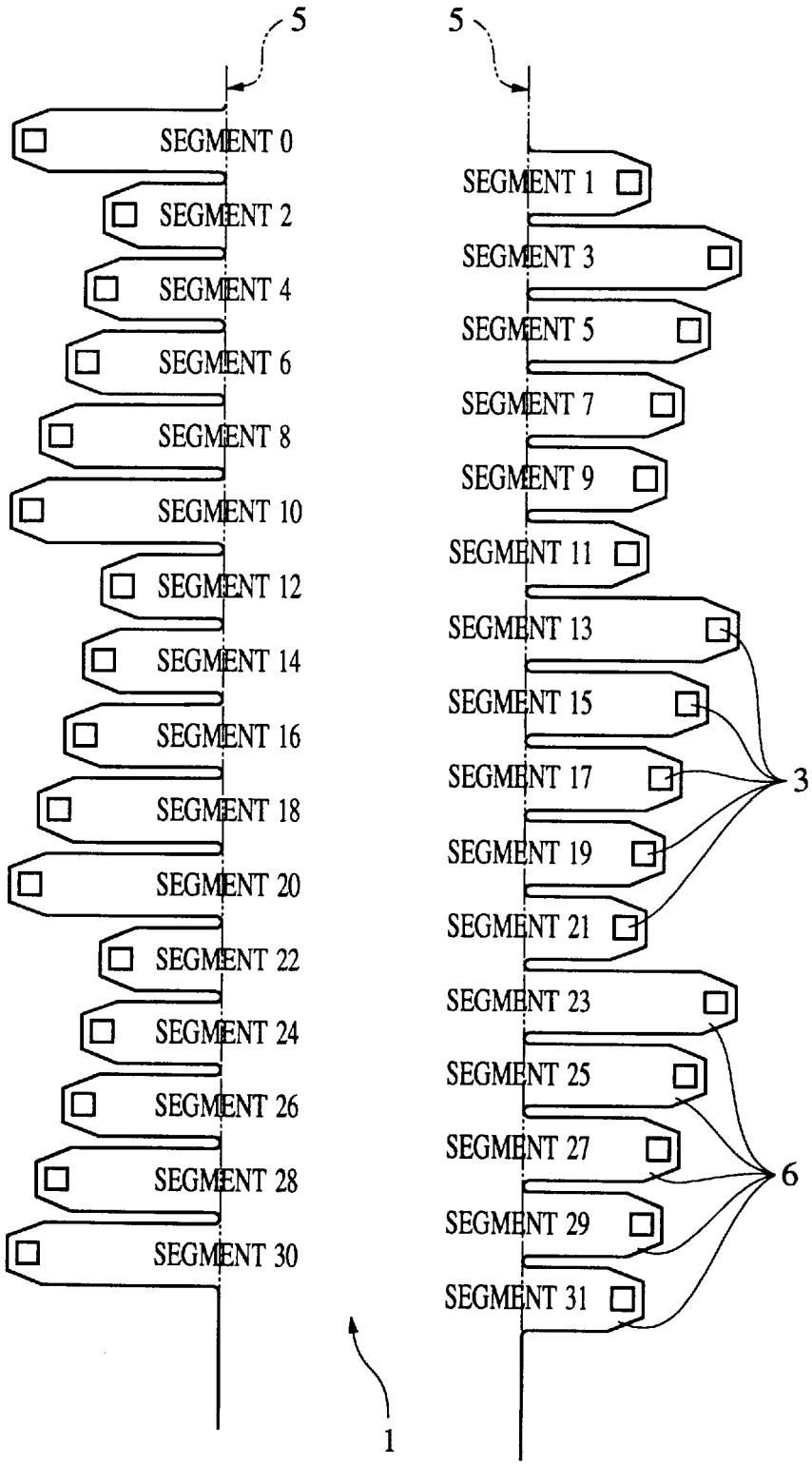
FIG. 8 is a schematic view showing a nozzle structure as a second example of the bubble jet recording head according to the background art.

As described above, when the timeshared drive is carried out, the arriving positions of ink droplets, which are otherwise off-set as shown in FIG. 7, can be maintained linearly as shown in FIG. 4, whereby an excellent image can be obtained.

Second Embodiment

Figure 5:
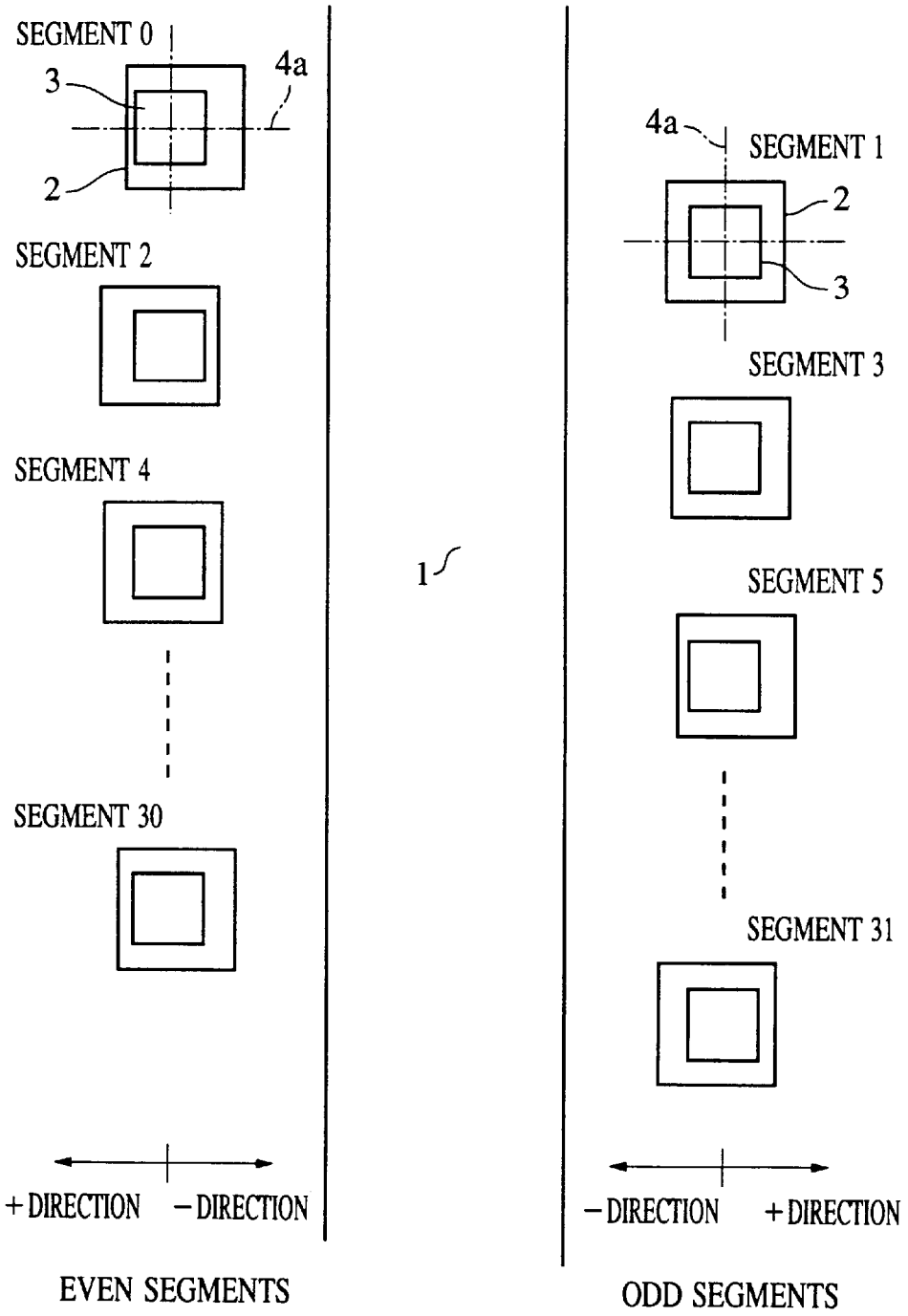
FIG. 5 is a schematic view showing a nozzle structure of an inkjet recording head as a second embodiment of the present invention.
Figure 6:
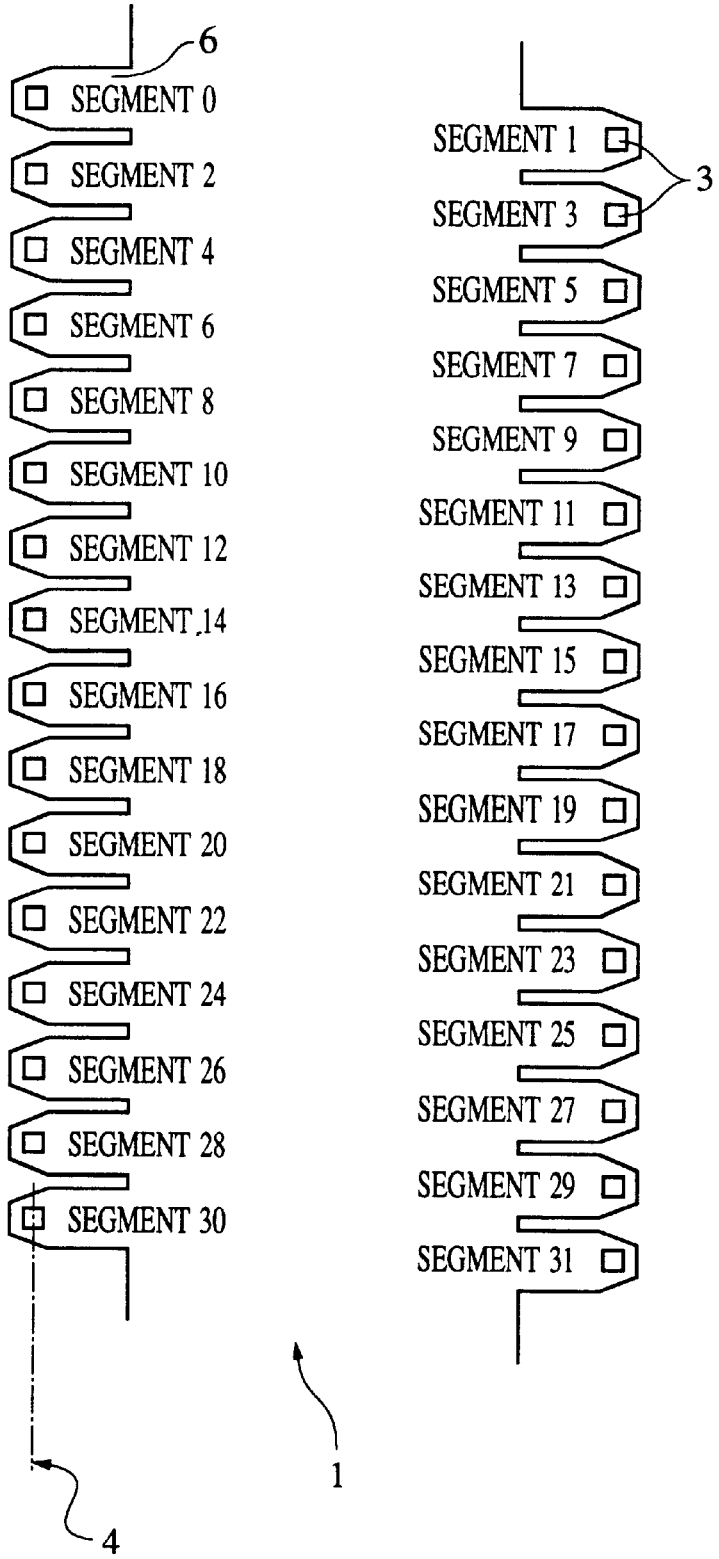
FIG. 6 is a schematic view showing a nozzle structure as a first example of a bubble jet recording head according to background art.

In a second embodiment, heaters are off-set with respect to ejecting ports disposed in a straight line as shown in FIG. 5, contrary to the first embodiment. The reference number 4*a* is a dot-dash-line showing a center of the ejecting port 3.

Also in the second embodiment, the distances between the centers of the respective hearers of the segments 0, 2, 4, . . . , 30 of an even heater group on a left side and the centers of the ejecting ports of the respective segments are set as described below. That is, the segment 0 is off-set +2 μm, the segment 2 is off-set −1.5 μm, the segment 4 is off-set −0.5 μm, the segment 6 is off-set 0 μm, the segment 8 is off-set +1 μm, the segment 10 is off-set +2.0 μm, the segment 12 is off-set −2.0 μm, the segment 14 is off-set −1.0 μm, the segment 16 is off-set 0 μm, the segment 18 is off-set +0.5 μm, the segment 20 is off-set +1.5 μm, the segment 22 is off-set −2.0 μm, the segment 24 is off-set −1.0 μm, the segment 26 is off-set −0.5 μm, the segment 28 is off-set +0.5 μm, and the segment 30 is off-set +1.0 μm in correspondence to the sequence of timeshared drive. In contrast, the distances between the centers of the respective hearers of the segments 1, 3, 5, . . . , 31 of an odd heater group on a right side and the centers of the ejecting ports of the respective segments are set as follows. That is, the segment 1 is off-set 0 μm, the segment 3 is off-set −0.5 μm, the segment 5 is off-set −1.5 μm, the segment 7 is off-set +2.0 μm, the segment 9 is off-set +1.0 μm, the segment 11 is off-set +0.5 μm, the segment 13 is off-set −0.5 μm, the segment 15 is off-set −1.0 μm, the segment 17 is off-set −0.2 μm, the segment 19 is off-set +1.5 μm, the segment 21 is off-set +0.5 μm, the segment 23 is off-set 0 μm, the segment 25 is off-set −1.0 μm, the segment 27 is off-set −2.0 μm, the segment 29 is off-set +2.0 μm, and the segment 31 is off-set +1.0 μm in correspondence to the sequence of timeshared drive.

In the second embodiment, the "going-away" ejection is executed by the segments which are timeshared driven at a first half timing or first to seventhly, that is, the even segments 0, 10, 20, 30, 8, 18, and 28 and by the segments which are timeshared driven at a second half timing or tenthly to sixteenthly, that is, the odd segments 11, 21, 31, 9, 19, 29, and 7, similarly to the first embodiment. Whereas, the "coming-near" ejection is executed by the segments which are timeshared driven at the second half timing or tenthly to sixteenthly, that is, the even segments 26, 4, 14, 24, 2, 12, and 22 and by the segments which are timeshared driven at the first half timing or first to seventhly, that is, the odd segments 17, 27, 5, 15, 25, 3, and 13. Since the heaters are not off-set with respect the centers of the ejecting ports of the even segments 6 and 16 and the odd segments 1 and 11 which are disposed at the middle portion of the segments and timeshared driven eighthly and ninthly, these segments eject ink droplets and form an image having linearlity as shown in FIG. 4.

It should be noted that while a difference of a C–H distance is 4 μm, nozzles having a short C–H distance and nozzles having a long C–H distance have almost no refill difference.

While a case in which the nozzles of the recording head are disposed in the two rows is described in the above embodiments, persons skilled in the art will understand that the number of the rows is not limited to two and that the present invention can be executed even if the number of the rows is more than two or the nozzles are disposed in only one row.

Figure 9:
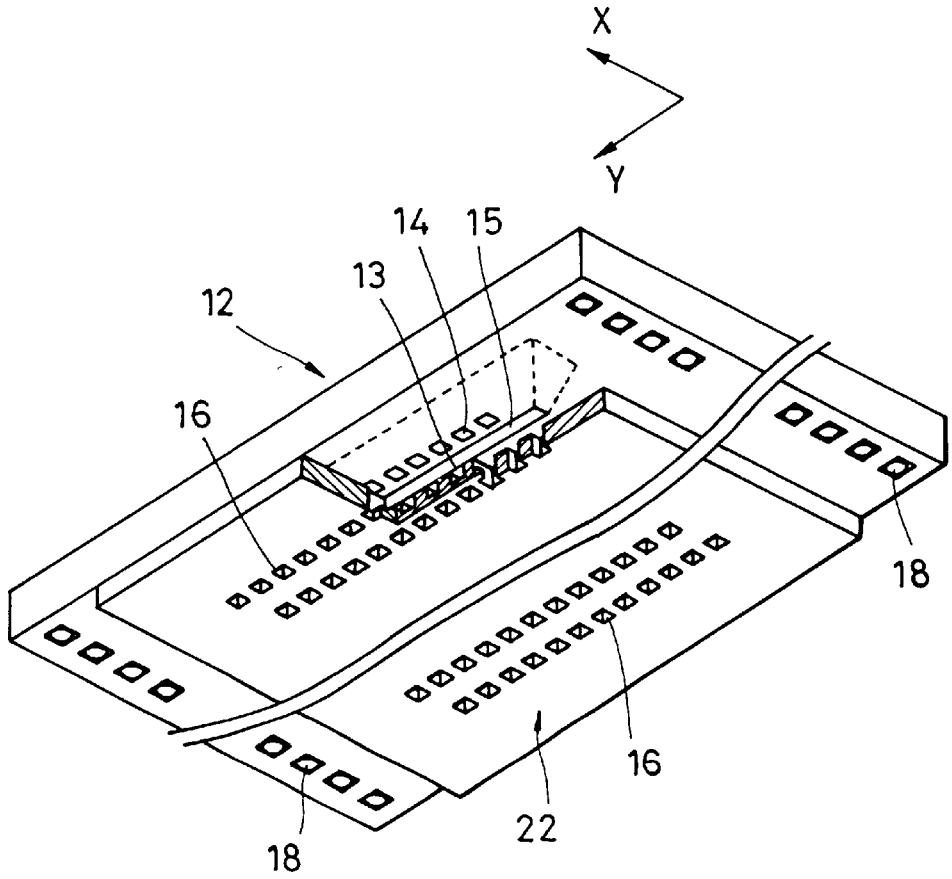
FIG. 9 is a perspective view, partly in cross section, showing a main portion of an inkjet head according to the embodiments of the present invention.
Figure 10:
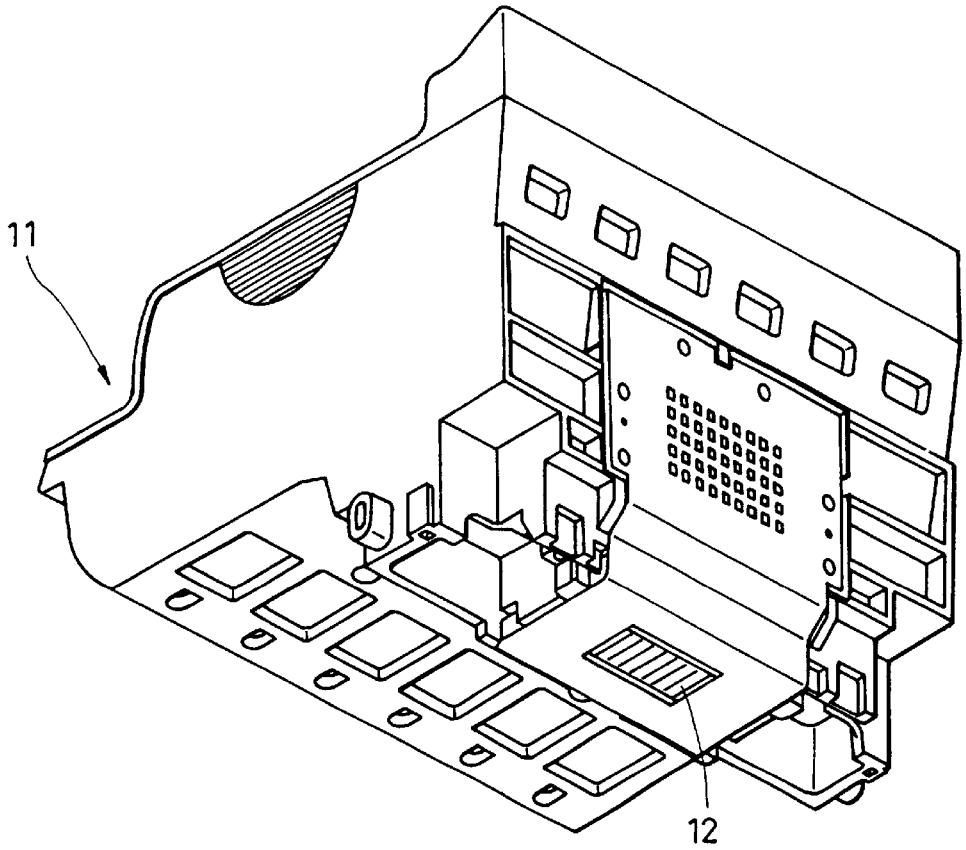
FIG. 10 is a perspective view showing an overall outline of the inkjet head according to the embodiments of the present invention.

FIG. 10 shows an overall outside view of an inkjet head 11 in the embodiments of the present invention, and FIG. 9 shows a head chip 12 as a main portion of the inkjet head 11 in a broken state. The head chip 12 is made using, for example, a Si wafer of 0.51 mm thick, and six slender ink supply ports 15, which are disposed in parallel with each other, are formed in correspondence to six color inks used in the inkjet head 11.

Ink chambers 13 are disposed at predetermined intervals in two rows along the lengthwise direction of the ink supply ports 15 so as to hold the ink supply ports 15 therebetween. Each ink chamber 13 has an electrothermal conversion element 14 and an ejecting port 16 which are disposed therein, the ejecting port 16 being positioned in confrontation with the electrothermal conversion element 14 so as to eject ink as a droplet.

In the embodiments, the ejecting ports 16, which are in parallel with each other in the two rows with the ink supply ports 15 held therebetween, are disposed in a so-called zigzag state by being off-set a half pitch one another so that the ink chambers 13 corresponding to the ejecting ports 16 of the respective rows are disposed at intervals of 600 dpi pitch. Thus, the ejecting ports 16 are apparently disposed at a high density of 1200 dpi along the lengthwise direction of the ink supply ports 15 in correspondence to the inks of the respective colors. Further, the electrothermal conversion elements 14 and electrode wirings 17 formed of Al or the like for supplying power to the electrothermal conversion elements 14 are formed on the surface of a Si wafer by a film firming technology, and the other end of each electrode wiring 17 is arranged as a bump 18 which is formed of Au and projects from the surface of a heating substrate 12.

The electrothermal conversion elements 14 in the embodiments are a part of a heating resistor layer 19, which is not covered with the electrode wirings 17 formed of Al or the like and is formed of, for example, TaN, TaSiN, TaAl or the like, and have a sheet resistance value of 53Ω. These electrothermal conversion elements 14 and electrode wirings 17 are covered with a protective layer 20 composed of SIN of 4000 Å thick, and a cavitation resistance layer 21 of 2300 Å thick composed of Ta is formed on the surface of the protective layer 20 on the electrothermal conversion elements 14.

The above-mentioned ink supply ports 15 are formed by anisotropic etching making use of the crystal direction of a Si wafer used as the heating substrate 12. That is, when the surface of the Si wafer is <100> and the Si wafer has a crystal direction <111> in the thickness direction thereof, the heating substrate 12 is etched in a desired depth by providing selectivity with it in an etching direction using an alkaline anisotropic etching solution such as KOH, tetramethylammonium hydroxide (TMAH), or hydrazine.

Further, the ink chambers 13 and the ejecting ports 16 are formed by photolithography. Then, ink droplets of, for example, 4 pico-litters are ejected from the ejecting ports 16 by energizing the electrothermal conversion elements 14.

Figure 11:
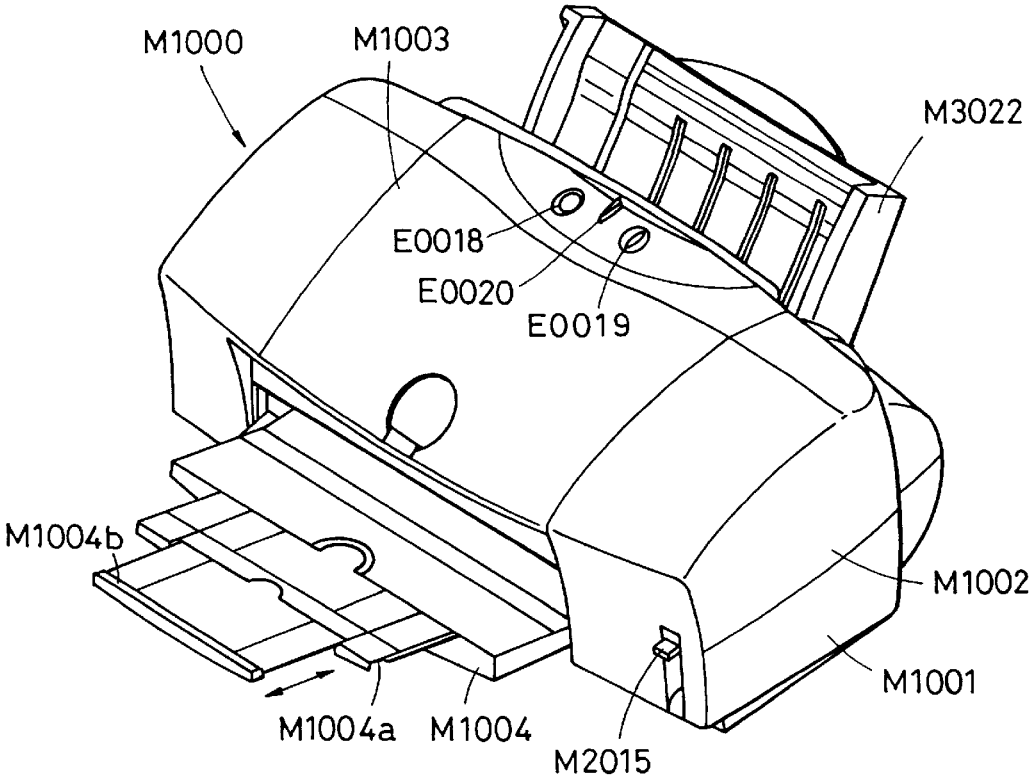
FIG. 11 is a perspective view showing an overall outline of an inkjet recording apparatus according to the embodiments of the present invention.
Figure 12:
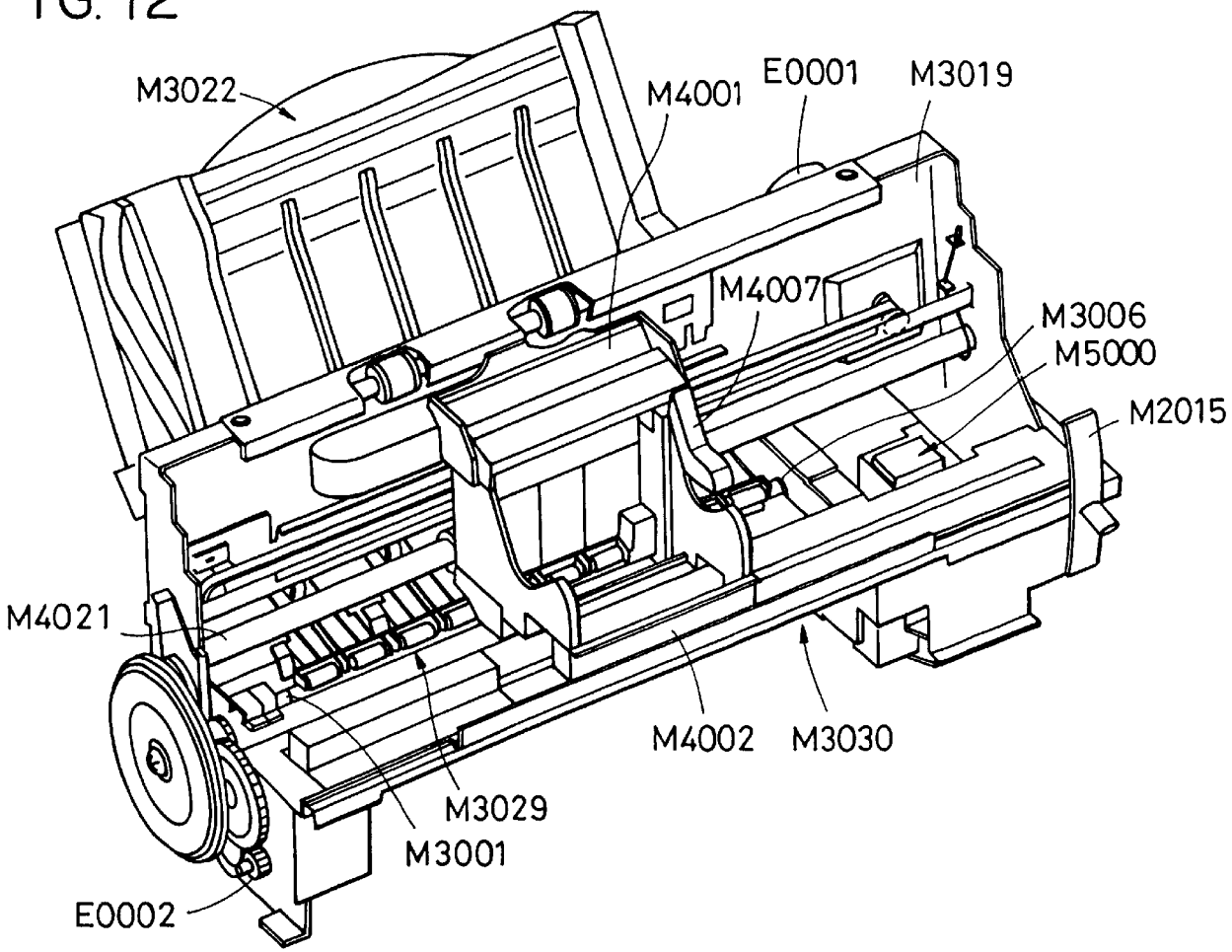
FIG. 12 is a perspective view showing a main portion of the inkjet recording apparatus according to the embodiments of the present invention.

FIGS. 11 and 12 show a schematic construction of a printer employing an inkjet recording system.

In FIG. 11, a main body M1000 acting as an outside shell of the printer according to the embodiments includes a lower case M1001, an upper case M1002, an access cover M1003, an exterior member of a discharge tray M1004, and a chassis M3019 accommodated in the exterior member (refer to FIG. 12).

The above chassis M3019 is composed of a plurality of metal sheets having a predetermined rigidity, acts as a framework of the printer, and holds respective recording operation mechanisms which will be described later.

Further, the lower case M1001 forms an approximately lower half portion of the main body M1000, and the upper case M1002 forms an approximately upper half portion thereof, both the cases are combined with each other so as to form a hollow structural member having an accommodating space therein in which the respective mechanisms to be described later are accommodated, and openings are formed on the upper surface and the front surface of the hollow structural member.

Further, the discharge tray M1004 is turnably supported by the lower case M1001 at an end thereof, and the opening formed on the front surface of the lower case M1001 can be opened and closed by turning the discharge tray M1004. As a result, when the printer executes recording operation, the opening is formed by turning the discharge tray M1004 forward so that recording sheets P can be discharged from the opening and successively placed on the discharge tray M1004. Further, two auxiliary trays M1004*a* and M1004*b* are accommodated in the discharge tray M1004, and a sheet support area can be increased or reduced in three steps by drawing out the respective trays forward as necessary.

The access cover M1003 is turnably supported by the upper case M1002 at an end thereof so as to open and close the opening formed on the upper surface. When the access cover M1003 is opened, a recording head cartridge, ink tanks and the like accommodated in the main body can be replaced. It should be noted that while not shown particularly here, when the access cover M1003 is opened and closed, a projection formed on the back surface thereof turns a cover opening/closing lever, and an open/close state of the access cover can be detected by detecting a turning position of the lever by a microswitch or the like.

Further, a power key E1008 and a resume key E0019 are disposed on the upper rear surface of the upper case M1002 so as to be depressed as well as an LED E0020 is disposed thereon. When the power key E1008 is depressed, the LED E0020 lights, indicating that recording is possible to an operator. The LED E0020 has various display functions which are executed in such a manner that it blinks differently, changes colors or sounds a buzzer. Note that when a trouble is overcome, recording can be resumed by depressing the resume key E0019.

Next, the recording operation mechanisms of the embodiments, which are accommodated in and held by the main body M1000 of the printer, will be explained. The recording operation mechanisms of the embodiments includes an automatic sheet feeder M3022 for automatically feeding recording sheets P into the main body of the printer, a sheet transportation unit M3029 for guiding the recording sheets P fed from the automatic sheet feeder one by one to a desired recording position as well as guiding the recording sheets P from the recording position to a sheet discharge unit M3030, a recording unit for recording desired data on the recording sheets P transported to the sheet transportation unit M3029, and a restoration unit M5000 for restoring the recording unit and the like. The recording unit is mainly composed of a carriage M4001 movably supported by a carriage shaft M4021 and a recording head cartridge detachably mounted on the carriage M4001.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An inkjet recording head having a plurality of ink ejecting ports and a plurality of energy generating elements respectively positioned in confrontation with the ink ejecting ports for generating energy utilized to eject ink from the ink ejecting ports, the plurality of ink ejecting ports and the plurality of energy generating elements being divided into a plurality of blocks, and the ejecting ports and the energy generating elements being timesharedly driven in a sequence of the blocks in a common driving period, wherein the plurality of ink ejecting ports are disposed in an approximate straight line, and the respective energy generating elements are off-set with respect to the ink ejecting ports in a projecting relationship in correspondence to the sequence of the timeshared drive.

2. An inkjet recording head according to claim 1, wherein the respective energy generating elements are off-set in a direction substantially perpendicular to the direction in which the ink ejecting ports are disposed.

3. An inkjet recording head according to claim 1, wherein a different amount of off-set is set to the respective energy generating elements in each block.

4. An inkjet recording head according to claim 1, wherein the ink ejecting ports and the energy generating elements are disposed in a plurality of rows.

5. An inkjet recording head according to claim 1, wherein a direction in which ink is supplied onto the energy generating elements is substantially perpendicular to a direction in which ink is ejected from the ink ejecting ports.

6. An inkjet recording head according to claim 1, wherein the energy generating elements are electrothermal conversion elements for generating thermal energy as the energy.

7. An inkjet recording head having a plurality of ink ejecting ports and a plurality of energy generating elements respectively positioned in confrontation with the ink ejecting ports for generating energy utilized to eject ink from the ink ejecting ports, the plurality of ink ejecting ports and the plurality of energy generating elements being divided into a plurality of blocks and the ejecting ports and the energy generating elements being timesharedly driven in a sequence of the blocks in a common driving period, comprising:

an inkjet recording head wherein the plurality of ink ejecting ports are disposed in an approximate straight line, and the respective energy generating elements are off-set with respect to the ink ejecting ports in a projecting relationship in correspondence to the sequence of the timeshared drive; and a member on which said inkjet recording head is mounted.

* * * * *